United States Patent [19]

Elsherbini

[11] Patent Number: 4,868,984

[45] Date of Patent: Sep. 26, 1989

[54] HAIR CUTTER

[76] Inventor: Magdi M. Elsherbini, 3250 Oakhurst, #6, Los Angeles, Calif. 90034

[21] Appl. No.: 115,366

[22] Filed: Nov. 2, 1987

[51] Int. Cl.[4] ..... B25F 3/00

[52] U.S. Cl. ..... 30/133; 30/41.5

[58] Field of Search ..... 30/201, 133, 41.5

[56] References Cited

U.S. PATENT DOCUMENTS

| | | | |
|---|---|---|---|
| 512,009 | 1/1894 | Chaney . | |
| 1,064,053 | 2/1911 | Coyle, Jr. . | |
| 2,980,994 | 4/1961 | Stachon | 30/133 |
| 4,314,405 | 2/1982 | Park . | |
| 4,590,675 | 5/1986 | Louw | 30/133 |
| 4,628,601 | 12/1986 | Van Slooten . | |

*Primary Examiner*—Douglas D. Watts
*Assistant Examiner*—Willmon Fridie, Jr.
*Attorney, Agent, or Firm*—Nemschoff & Supnik

[57] ABSTRACT

A hair cutter has a vacuum source connected tubular barrel and an interior shaft mounted turbine assembly. The turbine assembly includes a turbine coupled to a flywheel which in turn is coupled to a rotary blade assembly. A stationary radially disposed blade arrangement engages the rotatory blade arrangement. A pivot shaft arrangement is supported on the inside of the barrel joined to a longitudinal movable sleeve for adjusting the positioning of the internal assembly and couples the turbine to the flywheel and the flywheel to the rotary blade assembly. The turbine is coupled to the rotary blade assembly to create a rotary force to both rotate the rotary blade against the fixed blade, and to enhance the scissors force of the rotatory blade against the first blade by longitudinally urging the rotary blade toward the turbine. A vacuum source coupled to the barrel drives the turbine at one end of the barrel and the blade assembly is disposed adjacent an opening at the opposite end of the barrel. A grating is adjacent to and spaced apart from the blades.

9 Claims, 2 Drawing Sheets

HAIR CUTTER

FIELD OF THE INVENTION

This invention relates to cutting devices. In particular, the invention pertains to devices for cutting and clipping hair.

BACKGROUND OF THE INVENTION

When cutting human or animal hair, there are generally several objectives sought to be accomplished. The hair should be able to be cut easily without snagging. The cutting should be under control of the person using the cutter. The resulting appearance should be neat and clean. In addition, it is preferably that the hair cutting region be kept free from cut hair.

Various vacuum associated cutting devices have been used to attempt to achieve these objectives. Typically, they have been cumbersome and relatively expensive to produce. It would be advantageous to have a cutter for cutting human and animal hair which would be hair cleanly, and evenly yet retaining substantial control by the individual operating the cutter.

SUMMARY OF THE INVENTION

A hair cutter in accordance with this invention comprises a tubular barrel defining an axis and supporting a turbine and fixed and rotary blade cutters disposed along the axis. The turbine is coupled to a blade assembly to create a rotary force to both rotate the rotary blade against the fixed blade, and to enhance the scissors force of the rotatory blade against the first blade. The rotational forces are maintained during cutting by the rotational inertia supplied by a flywheel coupled to the turbine.

In a more specific example, the barrel is coupled to a vacuum source and the blade assembly is disposed adjacent an opening at the opposite end of the barrel. Additional features in accordance with this invention include adjustable positioning of the blades relative to the opening of the cutter and a grating disposed adjacent spaced apart from the blades allows hair to pass through the grating, while preventing the danger from the body coming in contact with the blades.

BRIEF DESCRIPTION OF THE DRAWINGS

The nature of the invention described herein may be best understood and appreciated by the following description taken in connection with the accompanying drawings in which.

DETAILED DESCRIPTION

Figure 1:
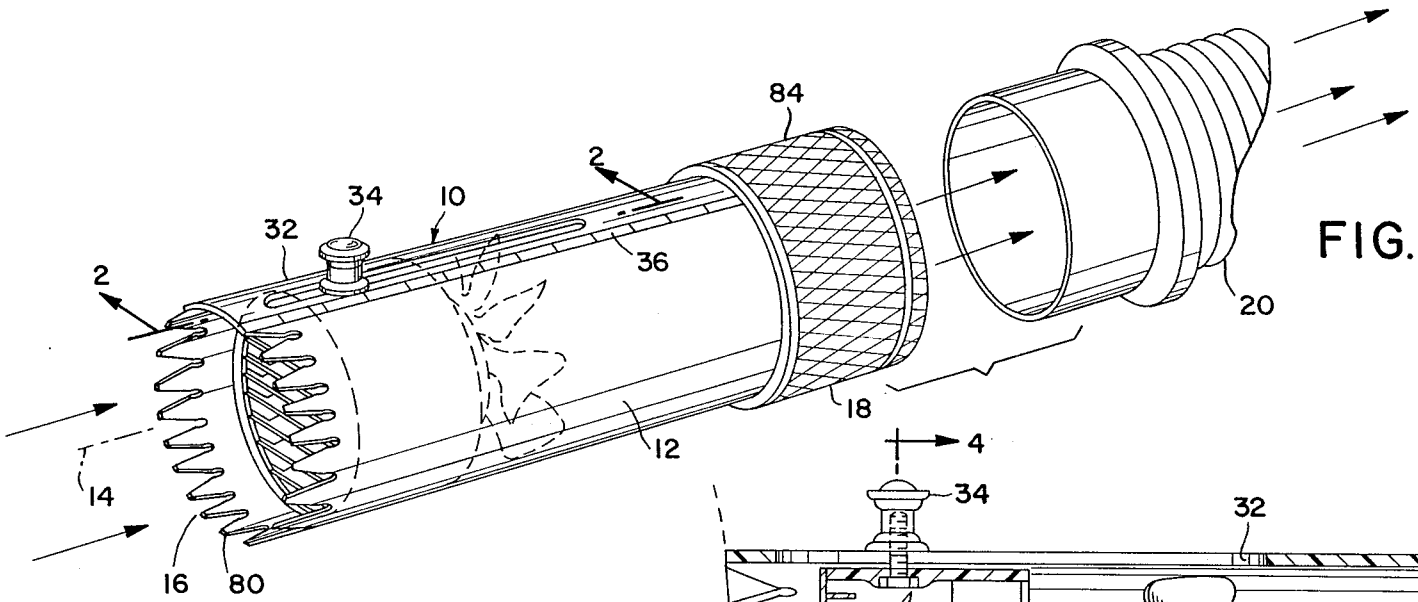
FIG. 1 is a perspective view of a portion the invention with portions shown in phantom.
Figure 2:
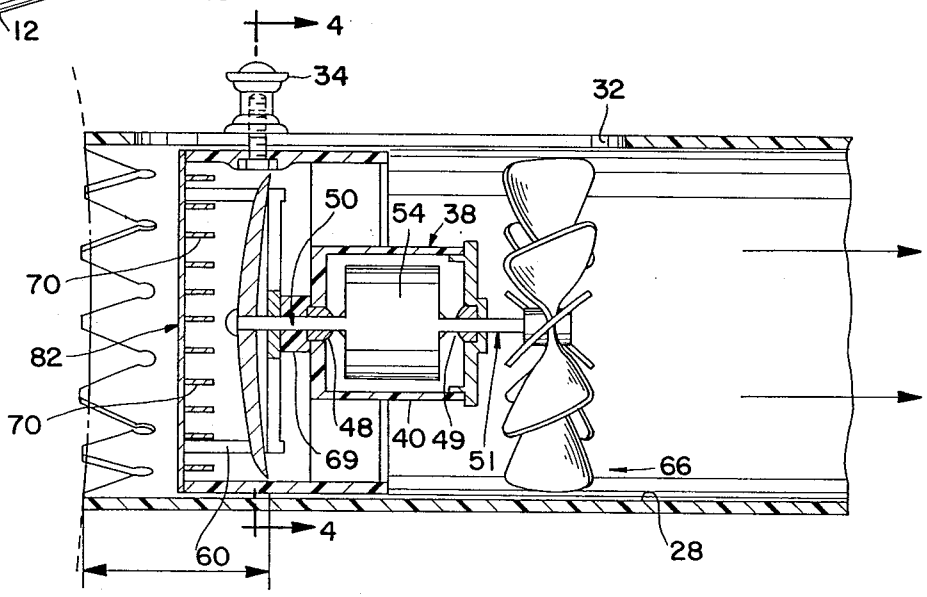
FIG. 2 is an elevational cross-sectional view taken along lines 2—2 of FIG. 1 with portions exposed and portions removed.

With particular reference to FIGS. 1, 2, 3 and 4, a hair cutter 10 in accordance with this invention generally comprises tubular barrel 12 defining a central axis 14 and having a front end 16 for receiving hair to be cut, and a back end 18 for coupling to a vacuum source 20.

The barrel 12 provides exterior support for the haircutter 10.

Figures 3, 4, 5:
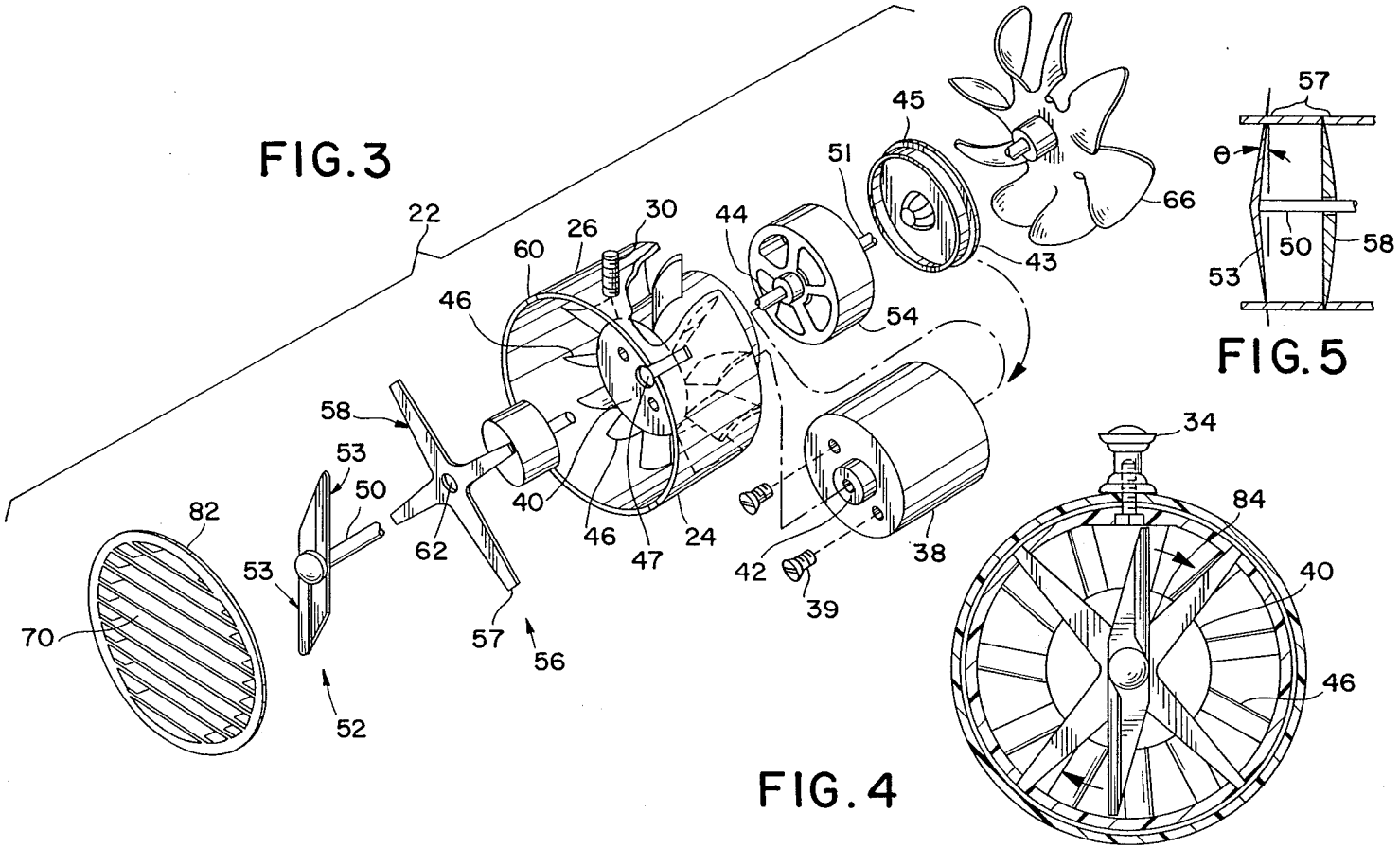
FIG. 3 is an exploded perspective view of the interior of the device depicted in FIG. 1.
FIG. 4 is an elevational cross-sectional view taken along lines 4—4 of FIG. 2.
FIG. 5 is an exploded detail elevational view taken along lines 5—5 of FIG. 4.

Disposed along the interior of the barrel 12 is a turbine driven cutting assembly 22 as best viewed in FIG. 3. The turbine driven cutting assembly 22 comprises an internal cylindrical sleeve 24 for supporting the cutting assembly 22 along the interior of the barrel 12. The sleeve 24 has an outer diameter 26 just less than the internal diameter 28 of the barrel 12 so that the sleeve 24 is movably longitudinally along the central axis 14 of the barrel 12.

Extending normally outward from the exterior of the sleeve 24 is a threaded member 30 which extends through a slotted aperture 32 adjacent the front end of the barrel 12 and is coupled to a mating adjustable thumb nut 34 for engaging the threaded member 30. The purpose of the slotted aperture 32 and the threaded member 30 is to enable the cutting assembly 22 to be movably adjusted longitudinally along the interior of the barrel 12.

The position of the sleeve 24 is adjustably set by the thumb nut 34. This allows adjustment of the cutting assembly 22 relative to the front end 16 of the barrel 12 and thus of the position of hair to be cut relative to the cutting assembly 22. A ruler 36 disposed on the exterior of the barrel 12 along the slotted aperture 32 provides for the noting of a preferred positioning of the cutting assembly 22 along the barrel 12.

A cylindrical casing 38 is disposed inside the sleeve 24. The casing 38 is joined to a hub 40 by machine screws 39. The cylindrical pivot support 38 defines a central axis about which is disposed a central bearing 42 for receiving a pivot rod 44. About the hub 40 is disposed a plurality of radially spaced apart spokes 46 for affixing the hub 40 to the interior of the sleeve 24. The spokes 46 are spaced apart and from one another, and the hub 40 is spaced apart from the interior surface of the sleeve 24 allowing a flow of air from the front end of the barrel 12 towards the vacuum source 20.

The hub 40 has a first end 41 facing the front end of the barrel 12, a first pivot aperture 47 and first bearing 48 for receiving a first pivot rod portion 50. The first pivot rod portion 50 extends at one end away from the hub 40 and is affixed to a rotary blade assembly 52 and at the other end is fixed to a flywheel 54 which is disposed within the casing 38. The second pivot portion 51 is coupled to and extends away from the flywheel 54 in the casing 38 opposite the first pivot rod portion 51, and is pivotally supported by the pivot bearing 49 and fixedly joined to a turbine 55. A rear cap 43 covers the casing adjacent the turbine and includes a bushing 45 for supporting the second pivot portion. The flywheel 54 establishes a rotational inertia to maintain a relatively uniform rotational movement despite any frictional slowdown which might be encountered during the cutting process.

The rotary blade assembly 53 is shown having two (2) blades, though a greater number of radially disposed and spaced apart blades 53 may be used. A stationary blade spider 56 has a plurality of radially disposed blade elements 58 disposed about a central axis defining an aperture 62 for receiving the first pivot rod portion 50. The stationary blade spider 56 is rotationally fixed by ends 57 of the blade elements 58 disposed within slots 60 at one end of the sleeve 24. The stationary blade assembly 56 has a central aperture 62 through which the first pivot rod portion 50 extends. The aperture 62 in the stationary blade spider 56 allows the rotational blade assembly 52 to rotate relative to the stationary blade assembly 56. Although four (4) blades 58 are shown in the drawings, the spider 56 may have a different number may of blades 58.

The turbine 55 comprises a fan hub 64 having a plurality of twisted petals 66 to create the turbine effect of both rotation and thrust, upon application of a vacuum source and tending to move through the barrel, along the pivot axis. The turbine 55 thus, when powered to the vacuum source supplies both the power that causes a relative rotational action of the blades 58 of the stationary blade spider 56 and rotary blades 53 but also, causes an axial movement, increasing the force between the blades 53, 58 and thereby enhancing their scissors action. A spacer 69 separates the support hub 38 from the stationary blade spider 56.

The grating 82 comprises a circular element having a round periphery and a plurality of transverse slats 70. The purpose of the grating 82 is to allow the air to be moved through the barrel 12 adjacent the blades, while avoiding injury from hands or other foreign objects from moving against the blades.

The rotary blades 52 and the stationary blades 58 as driven by the turbine 55 provide a smooth scissors action resulting in the cutting of the hair. Thus, as the rotatory blade 52 rotates, each of the rotary blades 53 while engaging one of the stationary blades 58, creates an intersection point 84 which moves from a region adjacent the central pivot of the barrel 12, to the exterior of the engaging blade 53, 58. At the same time in doing so, the turbine 55, while also driving the pivot portions 50, 51 in a rotational movement, causes the rotatory blades 53 to tend to move toward the turbine 55, thus, pulling the blades 53 tighter against the stationary blades 58. The effect of this action is to create a greater shearing force to cut the hair as it is passed through the slats 70 of the grating 82 and against the blades 53, 58.

The barrel 12 at the front end 16 has a plurality of ridges 80 for separating the hair received through the grating 82. The grating 82 is disposed at one end of the sleeve 24 adjacent the front end 16. At the back end 18 of the barrel 12, an exterior outer knurled surface 84 provides for easily attachment to the vacuum source 20.

With particular reference to FIG. 5, the nominal play 57 existing between the first and second blade assemblies is shown exaggerated for purposes of illustration. Typically the play is on the order of 0.1 inch or more. The play is removed as the rotary and stationary blades 53, 58 are brought adjacent one another from the forces exerted by the turbine. Also shown is the small acute angle at which the rotary blades 53 are disposed in relation to a plane normally to the axis of the pivot rod 50. Typically that angle is on the order of 2° to 5° and the term small acute angle is intended to refer to an angle of that size.

In use, a vacuum source 30 is attached to the barrel 12 of the cutter 10. The outer knurled surface 84 at the back end 18 of the barrel 12 is attached to the vacuum hose or other vacuum source 20. The vacuum causes a rotation of the turbine 16. The turbine 16 both rotates and tends to pull the shaft longitudinally in the direction of the turbine 16 toward the vacuum. This causes a pressure to be exerted by the rotating blade assembly against the stationary blade assembly, establishing a shearing force and causing the rotating blades to act against the stationary blade in a shearing action.

While the invention has been described with reference to specific forms thereof, it will be understood that changes and modifications maybe made within the spirit and scope of this invention.

What is claimed is:

1. Hair cutter apparatus comprising:

barrel means for receiving a turbine cutting assembly;

a turbine cutting assembly means for cutting hair when disposed within the barrel means, the turbine cutting assembly means disposed along a longitudinal axis within the barrel means; the turbine cutting assembly means comprising:

an axially disposed turbine for delivering a rotational torque to a blade assembly;

a first blade assembly comprising at least one first blade disposed within and fixed relative to the barrel;

a second blade assembly for engaging in shearing relationship and radially traversing the first blade means in a rotational scissors movement, the second blade assembly comprising at least one second blade disposed within the barrel;

the second blade positioned in closely adjacent relationship to the first blade;

pivot means for rotationally supporting the second blade assembly, for rotating the second blade assembly in coaxial relationship to the first blade assembly and for permitting longitudinal movement of the second blade assembly with respect to the first blade assembly and delivering a force to bring the second blade assembly in engagement with the first blade assembly;

the pivot means centrally disposed within the barrel defining a pivot axis and extending through the first blade assembly and coupled to the second blade assembly, the pivot means providing at least 0.1 inch play along the pivot axis between the first and second blade assemblies, the first blade having a cutting surface extending radially outward from the pivot means, the second blade having a cutting surface extending radially outward from the pivot means, the turbine means for generating sufficient power when coupled to a vacuum source to move the second blade means to contacting blade engagement with the first blade means, the intersection of the first and second blade surfaces defining an outwardly moving cutting wedge, the cutting wedge moving along the first blade adjacent the pivot means, and radially outwardly to the exterior radially outermost portion of the second blade as the second blade is moved across the first blade, the angle of the second blade disposed normal to the plane of a pivot at a small acute angle, the forces exerted by the blades on the hair thereby concentrating cutting force at the outwardly moving cutting wedge;

flywheel means for storing inertial energy along the central axis of the turbine and generally maintaining the generally uniformity of forces applied as the moving cutting wedges of the blades engage the hair, the flywheel means coupled by the pivot means to the second blade means;

the turbine coupled to the second blade assembly to cause the second blade to move in a scissors like rotational action with respect to the first blade assembly;

whereby the turbine applying both a rotational force for rotation of the second blade assembly with respect to the first blade assembly and applying a longitudinal force of the first blade assembly against the second blade assembly, so that when a vacuum source is applied to the first blade assembly, the turbine is caused to rotate, rotating the second blade assembly while applying a longitudinal force urging the second blade assembly toward the first blade assembly creating outwardly moving cutting wedges and providing a substantially uniform cutting force to cleaning and smoothly cut hair.

2. The invention as set forth in claim 1 and comprising means for supporting the turbine cutting assembly along the interior of the barrel means in moveable yet securable relationship.

3. The invention as set forth in claim 1 and comprising:

an interior sleeve adjustably movable longitudinally along the interior of the barrel, the interior sleeve adjustably supporting the first and second blade means to thereby adjust the positioning of the first and second blade means relative to the front end of the barrel;

grating means for allowing hair to pass through to the cutting assembly, while limiting the passage of foreign objects;

longitudinal slot means for receiving a securing member; and fastener means for adjustably fixing the securing member.

4. The invention as set forth in claim 1 and in which the first blade assembly comprises a plurality of blade members disposed radially about a pivot axis, each blade member having a cutting edge, the second blade assembly comprises a plurality of second blade members disposed about the pivot axis, a plurality of the second blade members being fixedly coupled to position the second blade assembly within the interior sleeve; and pivot means for axially aligning the first and second blade members whereby the first and second blade members can be brought into closely spaced apart relationship upon application of a torque provided by rotation of the turbine.

5. A hair cutter apparatus comprising:

a barrel for receiving a turbine cutting assembly;

a turbine cutting assembly for cutting hair when disposed within the barrel means, the turbine cutting assembly comprising an assembly supporting sleeve disposed within and longitudinally moveable along the barrel means, the turbine cutting assembly disposed along a longitudinal axis within the barrel means;

the assembly comprising a turbine disposed along the longitudinal axis of the sleeve for delivering a rotational torque to a blade assembly;

a first blade assembly comprising a first blade disposed within the barrel remote from the turbine;

a second blade assembly comprising a second blade disposed radially about the first blade axis within the barrel adjacent the first blade assembly, the first and second blades disposed in closely spaced apart relationship along the axis, a small nominal play between the first and second blades;

the first blade assembly comprising a plurality of blades radially disposed and fixedly coupled to the assembly and the second blade assembly comprising a plurality of axially blades rotatable about the longitudinal axis of the barrel and coupled to be driven by the turbine;

the sleeve movable along the longitudinal axis of the barrel, and means for fixing the position of the sleeve to define the position of the front end of the barrel to the first and second blade assemblies;

the turbine coupled to the second blade assembly to cause the second blade to move in a scissors like action with respect to the first blade assembly for applying both a rotational force for rotation of the second blade assembly with respect to the first blade assembly;

a flywheel coupled to the turbine to maintain a substantially uniform torque by the blade assemblies as hair is cut;

whereby a vacuum sources causes the turbine to apply a longitudinal force of the first blade assembly against the second blade assembly, and a rotational force, rotating the second blade assembly while applying a longitudinal force urging the second blade assembly toward the first blade assembly to take up the play between the first and second blades and cause a shearing action.

6. The invention set forth in claim 5 and comprising bearing means for supporting an axially disposed pivot arrangement, the bearing means coupled to the interior sleeve, and an axially disposed pivot arrangement, the pivot arrangement coupled to the turbine at one end, and to the rotary blade assembly at the other end to drive the rotary blade assembly against the stationary blade assembly and pull the rotary blade assembly against the stationary blade assembly.

7. The invention as set forth in claim 6 and in which the support element comprises a central hub and a plurality of spokes, whereby air pulled from a vacuum source is permitted to pass longitudinally through the barrel between the spokes.

8. The invention as set forth in claim 7 and comprising bearing means for supporting the pivot arrangement, and in which the bearing means comprises means for providing longitudinal play to allow a pulling by the turbine away from the stationary blade assembly, thereby allowing the rotary blade assembly to move toward and more tightly engage the stationary blade assembly.

9. A hair cutter apparatus comprising:

a barrel for receiving a turbine cutting assembly and defining a central longitudinal axis;

a sleeve movably disposed within the barrel and longitudinally moveable along the barrel;

a turbine disposed along the longitudinal axis of the sleeve for delivering a rotational torque to a blade assembly;

a radially disposed stationary blade assembly comprising plural radially disposed and spaced apart first blades disposed within the barrel remote from the turbine;

a radially disposed rotary blade assembly comprising plural radially disposed and spaced apart second blades disposed within the barrel adjacent the stationary blade assembly;

flywheel means for storing inertial energy along the central axis of the turbine, the flywheel means coupled to the turbine to drive the rotary blade assembly with a substantially uniform torque;

the turbine coupled to the rotary blade assembly to cause the rotary blade assembly to move in a scissors like action with respect to the stationary blade assembly for applying both a rotational force for rotation of the rotary blade assembly with respect to the stationary blade assembly;

the blades of the rotary blades assembly are disposed at a small acute angle to a plane normal to the axis of the rotary blade assembly, whereby a scissors action is applied to the stationary blades by the rotary blades, as a point of intersection between the stationary and rotary blades move outward along the stationary blades, and in which there exists a nominal play between the stationary blade assembly and the rotary blade assemblies; whereby the play is absorbed by an axial force exerted by the turbine;

the barrel defines a front end adjacent the stationary blade assembly and a back end remote from the stationary blade assembly and wherein a vacuum source is coupled to the back end of the barrel;

means for adjustably securing the sleeve to the barrel;

central support means for supporting the turbine and the rotary blades within the sleeve, and for allowing passage of air transversely through the barrel; and grating means disposed adjacent the front end for allowing passage of hair and air, while preventing larger foreign objects from entering the barrel;

whereby a vacuum sources causes the turbine to apply a longitudinal force of the rotary blade assembly against the stationary blade assembly, and a rotational force, rotating the rotary blade assembly while applying a longitudinal force urging the rotary blade assembly toward the stationary blade assembly.

* * * * *